United States Patent [19]

Sapp

[11] Patent Number: 4,723,803

[45] Date of Patent: Feb. 9, 1988

[54] LEAF BAGGING DEVICE

[76] Inventor: James R. Sapp, 103 Avon Dr., Taylors, S.C. 29687

[21] Appl. No.: 933,877

[22] Filed: Nov. 24, 1986

[51] Int. Cl.[4] ..... A47F 13/08; B65F 1/06

[52] U.S. Cl. ..... 294/55; 294/1.1

[58] Field of Search ..... 294/55, 1.1, 19.1, 93, 294/97, 99.1; 248/95, 97, 99, 100, 101; 15/104.8, 257.1, 257.3, 257.4, 257.5, , 257.7, 257.8; 383/33

[56] References Cited

U.S. PATENT DOCUMENTS 3,942,832 3/1976 Haas, Jr. ..... 294/55

4,023,842 5/1977 Harvey ..... 294/55

*Primary Examiner*—James B. Marbert

*Attorney, Agent, or Firm*—Bailey & Hardaway

[57] ABSTRACT

A portable hand carried apparatus for positioning plastic leaf bags is illustrated wherein a pair of diverging arms carried by a handle spread the bag in open position between the free ends of the arms and positive means are provided for securing the open edge of the bag along the arms which are secured manually by the user to quickly and positively fasten the bag in open position for the reception of leaves.

3 Claims, 3 Drawing Figures

LEAF BAGGING DEVICE

BACKGROUND OF THE INVENTION

Numerous portable hand devices have been provided for maintaining the the usual plastic refuse bags in open position to receive leaves, sticks and the like. Exemplary of such devices are those disclosed in U.S. Pat. Nos. 3,942,832, 4,023,842 and 4,048,691.

U.S. Pat. No. 3,942,832 discloses a circumferential frame for maintaining the bag in open position with an elastic cord received in grooves about the continuous frame for confining the open end of the bag in the groove. U.S. Pat. No. 4,023,842 discloses a resilient metallic frame which is open at the free end and relies upon the resiliency of the frame for maintaining the bag upon the diverging frame members. U.S. Pat. No. 4,048,691 illustrates the use of a triangular circumferential frame for maintaining a leaf bag in open position with a slidable member carried by the handle for engaging and stretching the bag to open position.

Such devices have failed to satisfy bag spreaders in that the bags are either not positively positioned or such fail to present an opening having a desirable arcuate shape with the lower edge being maintained for ground engagement without interference with the open end of the bag for the reception of refuse therein.

Accordingly, it is an important object of the invention to provide a device essentially in the shape of a trash receptacle of wishbone configuration to provide a flat ground engaging portion free of obstacles with an arcuate shaped opening for facilitating the placement of leaves and the like within the bag with quick fastening means facilitating effective securement of the bag in open position.

SUMMARY OF THE INVENTION

It has been found that a hand-held leaf collector may be provided affording a flat lower ground engaging edge of the bag free of obstacles with an arcuate opening for providing flat arcuate diverging arms having a free end for spreading the lower edge of the bag with the provision of a cord for affording a quick securement for the open end of the bag in positive engagement through a positioning of the cord about the flat outer surface of the arcuate arms, preferably with Velcro attachment means at a free end of the respective cords attached at each of the free ends of the arms.

BRIEF DESCRIPTION OF THE DRAWINGS

The construction designed to carry out the invention will be hereinafter described, together with the other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a molded plastic hand carried leaf bagging device for positioning a leaf bag in open position to receive leaves and the like having a rearwardly inclined handle A. A pair of diverging arms B extend outwardly in opposed relation from the handle forming an integral juncture presenting an inner surface beneath the handle. The arms present a substantially flat surface disposed generally longitudinally in alignment with the handle affording a skirt about which an open edge of the leaf bag may be disposed with the leaf bag being in open configuration to receive leaves. The flat surface is of a substantially arcuate shape to maintain the leaf bags open at the top to receive leaves with a flat ground engaging portion being held open between spaced free ends of the arms. A cord C is held adjacent the spaced free ends of each arm. Means D are carried by the arms position and secure the cord about the open edge of the leaf bag releasably fastening the leaf bag about the arms in open position for reception of leaves. Thus, the leaf bag presents a flat ground engaging portion to facilitate reception of leaves through an arcuate opening defined by the arms. The means D carried by the arms positioning the cord include spaced guides for positioning the cord about the arms and wherein a respective cord extends from each of the free ends of the arms. A Velcro strip is carried at a free end of each respective cord, and a Velcro patch is carried adjacent the inner surface beneath the handle.

The leaf bagging device is preferably injection molded of suitable plastic. The handle A is inclined upwardly and rearwardly and includes a flat upper portion 10 together with a reinforcement grip 11 and a rib reinforcement 12 integral therewith.

Figure 1:
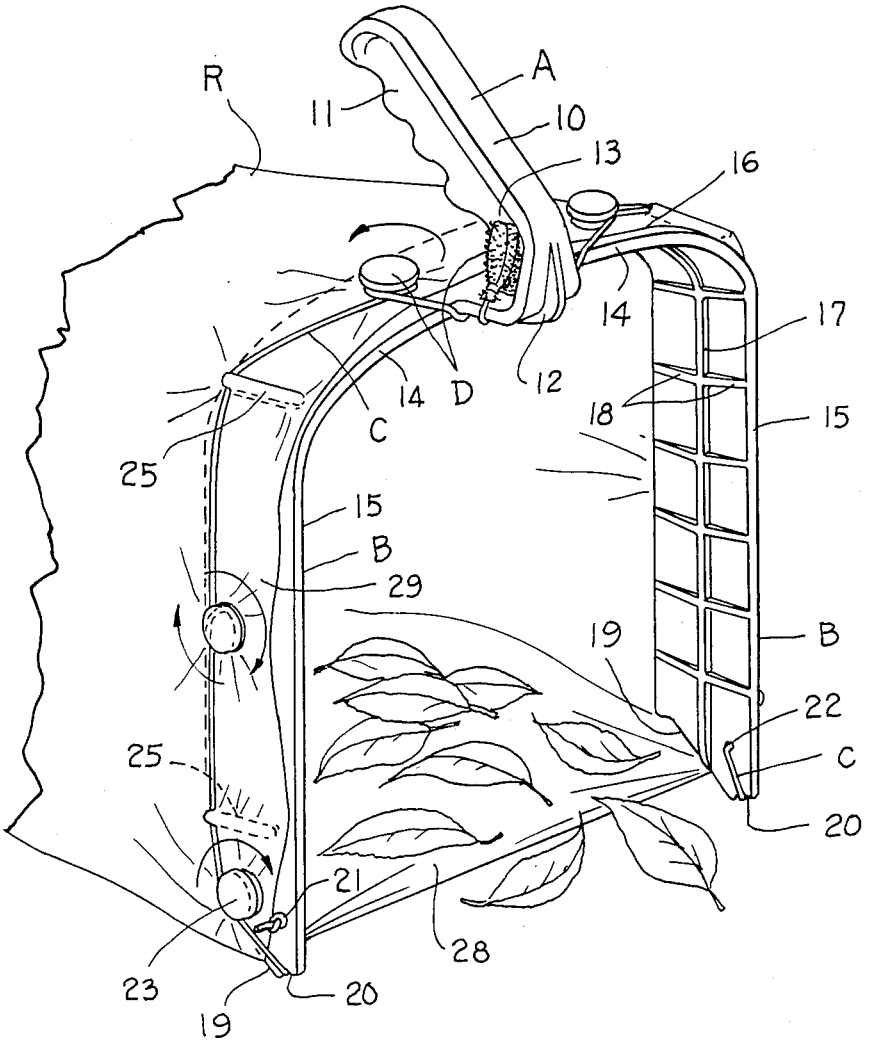
FIG. 1 is a perspective view of a hand carried leaf collector constructed in accordance with the invention.
Figure 3:
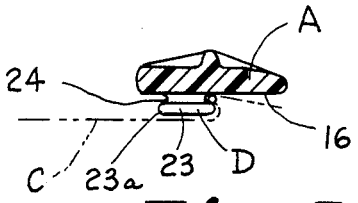
FIG. 3 is a sectional plan view taken on the line 3—3 in FIG. 2 further illustrating the securement means.
Figure 2:
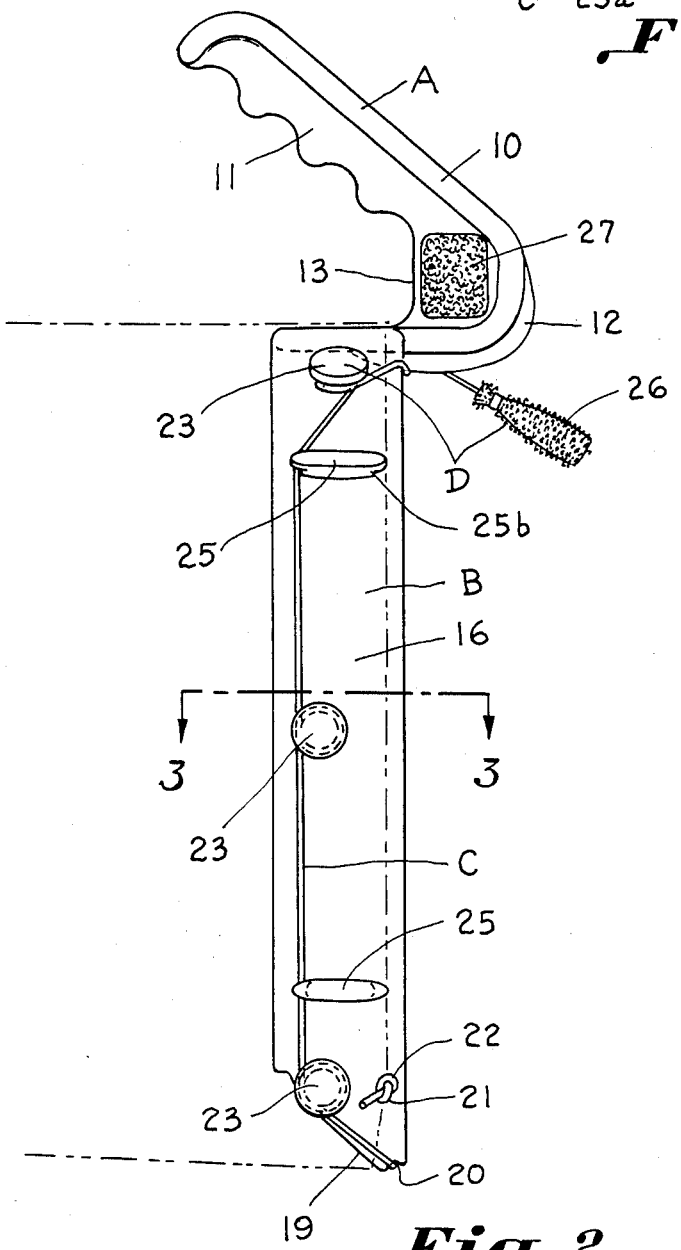
FIG. 2 is a side elevation illustrating bag securement constructed in accordance with the invention.

A pair of diverging arms B extend outwardly in opposed relation from the handles forming an integral juncture 13. The integral juncture 13 presents an inner surface beneath the handle serving as reinforcement as well as beneath the surface for the positioning of cord fastening members thereon. The pair of diverging arms B extend outwardly in opposed relation as at 14 and are substantially flat. The arms B then extend downwardly in spaced relation as at 15 and are joined together by an arcuate portion so as to present a flat outer perimeter as illustrated at 16 extending entirely about the arms passing beneath the handle A. The arms may be provided with longitudinal reinforcement as at 17 as well as laterally extending ribs 18. The arms B have free ends which extend rearwardly and upwardly as illustrated at 19 to accommodate the bag and aid in positioning same flat against the ground. The free ends of the arms afford an outwardly extending groove as illustrated at 20. A cord C is held adjacent the spaced free ends of each of the arms as by utilizing a knot 21 positioned on the outside of the arms permitting the cord to extend through an opening 22 adjacent the free ends of the arms and thence pass through the respective slot 20 and up the outside perimeter of the arms about the securement means D. The securement means D include projections 23 having a groove 24 between an enlarged head portion **23*a* (FIG. 3) and the flat outer perimeter 16 of the arms about which the cord may be wrapped as indicated by the arrows in the drawing positioned successively about the outwardly projecting guide 25 presenting grooves 25*b* for guiding the cord successively about the outwardly projecting fastening members 23. The cord has a Velcro portion 26 adjacent its free ends and a Velcro patch 27 carried by the inner surface 13 beneath the handle thus bypassing the cord about the outwardly projecting fastening members passing the guides 25 and securing the Velcro attachments. The refuse bag R may be secured in open position for the reception of leaves as illustrated in FIG. 1. The open end of the bag has a flat lower portion illustrated at 28 and a marginal portion 29 about which the respective cords pass upward over the outer perimeter surfaces 29** of the arms for securement of the bag to the arms for the reception of leaves.

It is thus seen that a simple structure is provided for maintaining the refuse bag in open position for the reception of leaves with a flat lower portion positioned adjacent the ground in such a way that the remainder of the bag is securely positioned in open relation about an integral bag positioning hand-held apparatus.

While a preferred embodiment of the invention has been described using specific terms, such description is for illustrative purposes only, and it is to be understood that changes and variations may be made without departing from the spirit or scope of the following claims.

That which is claimed is:

1. a molded plastic hand carried leaf bagging device for positioning a leaf bag in open position to receive leaves and the like comprising;

a pair of diverging arms extending outwardly and down;

said arms presenting a substantially flat surface affording a skirt about which an open edge of the leaf bag may be disposed with the leaf bag being in open configuration to receive leaves;

said flat surface being of a substantially arcuate shape to maintain the leaf bags open at the top to receive leaves with a flat ground engaging portion being held open between spaced free ends of said arms;

a handle carried at the juncture of said arms extending rearwardly and upwardly therefrom yet not in interference with the flat surface about which an open edge of a leaf bag may be disposed;

a cord held adjacent said spaced free ends of each arm; and means carried by said arms positioning and securing said cord about said open edge of said leaf bag releasably fastening said leaf bag about said arms in open position for reception of leaves;

whereby said leaf bag presents a flat ground engaging portion to facilitate reception of leaves through an arcuate opening defined by said arms.

2. The structure set forth in claim 1 wherein said means carried by said arms positioning said cord include spaced guides for winding said cord about said arms and wherein a respective cord extends from each of said free ends of said arms, a Velcro strip carried at a free end of each respective cord, and a Velcro patch carried adjacent said inner surface beneath the handle.

3. The structure set forth in claim 1 wherein said lower surface carried by each of said arms at a lower end thereof extends rearwardly and upwardly to accommodate the leaf bag and aid in positioning same flat against the ground when the device rests on the ground.

* * * * *